US006622351B2

(12) United States Patent
Takasawa

(10) Patent No.: US 6,622,351 B2
(45) Date of Patent: Sep. 23, 2003

(54) SLIDER FOR AIRTIGHT AND WATERTIGHT SLIDE FASTENER

(75) Inventor: Shigeyoshi Takasawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/983,380

(22) Filed: Oct. 24, 2001

(65) Prior Publication Data

US 2002/0050030 A1 May 2, 2002

(30) Foreign Application Priority Data

Oct. 31, 2000 (JP) ..... 2000-332880

(51) Int. Cl.[7] ..... A44B 19/32
(52) U.S. Cl. ..... 24/415; 24/389
(58) Field of Search ..... 24/389, 415, 403, 24/392, 401, 391, 417, 428

(56) References Cited

U.S. PATENT DOCUMENTS 3,711,903 A * 1/1973 Brown ..... 24/401
3,757,391 A * 9/1973 Cuckson et al. ..... 24/408
4,000,546 A * 1/1977 Takamatsu ..... 24/427
4,099,302 A * 7/1978 Frohlich et al. ..... 24/392
6,343,408 B1 * 2/2002 Neugebauer ..... 24/389

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

A slider for an airtight and watertight slide fastener, which guides a seal member and said slide fastener stably and smoothly and which is capable of obtaining excellent airtightness and watertightness. A body of the slider has an upper wing and a lower wing with flanges on both of right and left sides, respectively, connected by a guide post. A partition plate is arranged in the middle of the guide post to form an insertion path for a seal member on an upper side thereof and form an insertion path for a linear fastener element or a discrete fastener element on a lower side thereof. A protruding bar is integrally provided at a distal end of the partition plate toward the rear port. In the case of the linear fastener element, an element pressing portion is provided therein. This slider appropriately separates the seal member and the fastener elements and guides them to have good coupling state, so as to stably effect an airtight and watertight function.

10 Claims, 12 Drawing Sheets

SLIDER FOR AIRTIGHT AND WATERTIGHT SLIDE FASTENER

BACKGROUND OF THE INVENTION

1. Field of the Invention

The present invention relates to a slider for an airtight and watertight slide fastener chain having flexibility, which is capable of sealing air, water and other fluids by providing a waterproof function to a fastener tape in this slide fastener.

2. Description of the Related Art

In a conventional airtight and watertight slide fastener as shown in FIG. 16, a metal discrete fastener element 41' is attached along a longitudinal edge of a fastener tape 31' and an elastic material such as a natural rubber, a synthetic rubber and a thermoplastic resin provided with an elasticity is adhered on a surface of this fastener tape 31'. Then, these elastic materials are also adhered on a surface of this fastener element 41' by an adhesive agent to form seal primary bodies 33'. In one of the seal primary bodies 33' on the surface of this fastener element, its longitudinal edge forms an abutting surface being inclined, and in other one of the seal primary bodies 33' on the surface of this fastener element, a seal surface 34' is formed on a lower part thereof with its side edge protruding at an acute angle. When the fastener elements are coupled with each other, the seal surface is slid on the abutting surface so that the surface thereof becomes flat to be sealed. Such an airtight and watertight slide fastener element is disclosed in Japanese Patent Application Publication No. 33-5328.

According to the airtight and watertight slide fastener shown in FIG. 16 described above, when right and left fastener stringers are coupled with each other, the surface of the seal primary bodies made of the elastic material is flat to be sealed, so that it is not necessary to use a slider of a special shape for opening and closing a fastener chain. A normal slider is used in which guide flanges of the same widths are provided on both sides of an upper wing and a lower wing and the upper wing and the lower wing are connected by a guide post.

Accordingly, the airtight and watertight slide fastener of this type is not capable of securely maintaining an airtight and watertight function, since a portion where the right and left seal primary bodies are overlapped is small. Further, it is not possible to easily manufacture a fastener chain. As a result, this type airtight and watertight slide fastener involves problems.

SUMMARY OF THE INVENTION

Therefore, the present invention provides a slider capable of being equipped to the fastener chain in order that an airtight and watertight slide fastener capable of certainly effecting the airtight and watertight function can be practically applied.

An object of the present invention is to provide a slider for an airtight and watertight slide fastener capable of certainly effecting the airtight and watertight function. The fastener chain of the slide fastener is fitted with a linear fastener element, for example, a coil fastener element formed by a mono-filament made of a synthetic fiber or a fastener element in zigzag on one surface of the fastener tape. Further, an elastic material for sealing is attached on a surface of the fastener element to form a seal member. Further, in the fastener chain with the airtight and watertight function, a close area in which the seal members at coupling sides are overlapped when the fastener elements are coupled with each other is formed and a slider is capable of opening and closing the fastener chain having such a function.

Another object of the invention is to provide a slider for an airtight and watertight slide fastener capable of certainly effecting the airtight and watertight function. The fastener chain is fitted with discrete fastener elements, for example, fastener elements made of a pressed metal or fastener elements made of thermoplastic resin by injection-molding on one surface of the fastener tape. Further, on a surface of the fastener element, an elastic material for sealing is attached to form a seal member. Further, in the fastener chain with the airtight and watertight function, a close area in which the seal members at coupling sides are overlapped when the fastener elements are coupled with each other is formed and a slider is capable of opening and closing the fastener chain having such a function.

Another object of the invention is to provide a slider for an airtight and watertight slide fastener provided with a mechanism enabling appropriately separating a seal member for sealing, which are provided with the airtight and watertight function, and the fastener elements and guiding a good coupled posture.

Another object of the invention is to provide a slider for an airtight and watertight slide fastener, which is guided upon the operation of opening and closing in a state that the coupled posture of the fastener chain provided with the linear fastener element is stable and is capable of appropriately effecting the airtight and watertight function.

Another object of the invention is to provide a slider for an airtight and watertight slide fastener, provided with the linear fastener element or the discrete fastener element, the slider being capable to be easily composed by forming the slider for sealing, which is suitable for a fastener chain provided with the airtight and watertight function, to be divided into some component members.

Another object of the invention is to provide a slider for an airtight and watertight slide fastener which can be formed all at once by integrally molding the slider for sealing suitable for the fastener chain with the airtight and watertight function provided with the linear fastener element or the discrete fastener elements, by a metal die casting molding.

Another object of the invention is to provide a slider for an airtight and watertight slide fastener, suitable for a specified configuration of the fastener chain fitted with the slider for sealing and provided with the airtight and watertight function, so that the fastener chain effecting the excellent airtight and watertight function can be provided.

In order to attain the above described objects, a main structure of the invention is a slider for an airtight and watertight slide fastener; wherein a body of the slider has an upper wing and a lower wing with flanges and on both of right and left sides, respectively, connected by a guide post, to form the slider; a partition plate is arranged in the middle of the guide post in parallel with the upper and lower wings to form an insertion path for a seal member on an upper side in the slider and form an insertion path for a linear fastener element on a lower side in the slider and pressing portions and for pressing and guiding the linear fastener element to extend from the guide post to the rear port of the slider are formed at any one of the partition plate and the lower wing. Therefore, this slider is most suited for a fastener chain utilizing a linear fastener element, on the surface of which the seal member for sealing is attached and further, provided with an airtight and watertight function by forming an area where the seal members are overlapped and closed when the seal members are coupled with each other. Further, this slider appropriately and easily guides the seal members which are overlapped and closed as well as guides the linear fastener element in a stable state, so that it can smoothly perform the opening and closing operation and can effect the airtight and watertight function stably.

Another structure of the invention is a slider for an airtight and watertight slide fastener for a discrete fastener element; wherein a body of the slider having an upper wing and a lower wing with flanges on both of right and left sides, respectively, connected by a guide post, to form the slider; a partition plate is arranged in the middle of the guide post in parallel with the upper and lower wings to form an insertion path for a seal member on an upper side in the slider and form an insertion path for a discrete fastener element on a lower side in the slider and the opposing surfaces of the partition plate and the lower wing plate are formed in flat surfaces. Therefore, this slider is most suited for the fastener utilizing discrete fastener elements, on the surface of which the seal member for sealing is attached for forming the area where the seal members are overlapped and closed when the seal members are coupled with each other. Further, this slider appropriately and easily guides the seal members which are overlapped and closed as well as guides the discrete fastener elements in a stable state, so that it can smoothly perform the opening and closing operation and can effect the airtight and watertight function stably.

Preferably, a protruding bar is integrally provided on the partition plate to extend toward the rear port, on a distal end of the partition plate at the side of the rear port, which is fixed on the guide post. Therefore, the slider appropriately and easily separates the seal members for sealing from the linear or the discrete fastener elements and holds the coupling posture of the fastener elements in a good state, so that the slider smoothly performs the opening and closing operation.

Preferably, the pressing portions for pressing and guiding the linear fastener element extending from the guide post to the rear port are formed on both of the opposing surfaces of the partition plate and the lower wing, which are fixed on the guide post, on the partition plate and the lower wing. Therefore, the fastener elements in coil shape or the fastener elements in zigzag shape are appropriately pressed from upper and lower directions and are guided so as to make the correct coupling posture.

Preferably, the slider for sealing is composed of three members, namely, an upper wing member, a lower wing member and a partition plate member in such a manner that an upper guide post protruded toward the lower wing member is provided on the upper wing member; a lower guide post protruded toward the upper wing member is provided on the lower wing member; and a partition plate member is arranged between the upper guide post and the lower guide post to be clipped therebetween by the upper guide post and the lower side guide post so as to compose the slider. Therefore, the slider is capable of being easily manufactured and the sizes of the upper wing and the lower wing are capable of being appropriately changed, so that various type sliders can be easily manufactured.

Further preferably, an insertion bar is provided on one of the opposing surfaces of the upper guide post of the upper wing member and the lower guide post of the lower wing member; an insertion hole, in which the insertion bar is capable of being inserted, is provided on the other of the opposing surfaces of the upper guide post and the lower guide post; and a through hole, in which the insertion bar is capable of being inserted, is provided on the partition plate member. Therefore, the guide post at the upper side of the slider and the guide post at the lower side of the slider are easily and appropriately composed.

Still further preferably, a shelf portion on which the partition plate member can be placed and fixed is provided on any one of the opposing surfaces of the upper guide post of the upper wing member and the lower guide post of the lower wing member. Therefore, the partition plate of the slider is easily composed in a stable state.

Preferably, a slider in which the upper wing, the lower wing, the guide post and the partition plate to compose the slider are arranged at predetermined positions, is integrally molded by die cast molding by using a metal. Therefore, the slider provided with the airtight and watertight function can be manufactured all at once and efficient manufacturing is realized.

Also preferably, a spacing between the flanges provided at opposite sides of the insertion path where the seal members are inserted through is narrower than a spacing between the flanges disposed at opposite sides of the insertion path wherein the fastener elements are inserted through. Therefore, the flanges disposed at the opposite sides of the insertion path for the seal member positively facilitate the seal members to protrude and come to contact closely and also to keep the protruding state consistent at the time of coupling of the fastener elements, so that the coupling of the fastener elements can be performed stably. As a result, this invention has very prominent effects.

DESCRIPTION OF THE PREFERRED EMBODIMENTS

Embodiments of a slider for an airtight and watertight slide fastener according to the present invention will be explained with reference to the accompanying drawings below.

Figure 5:
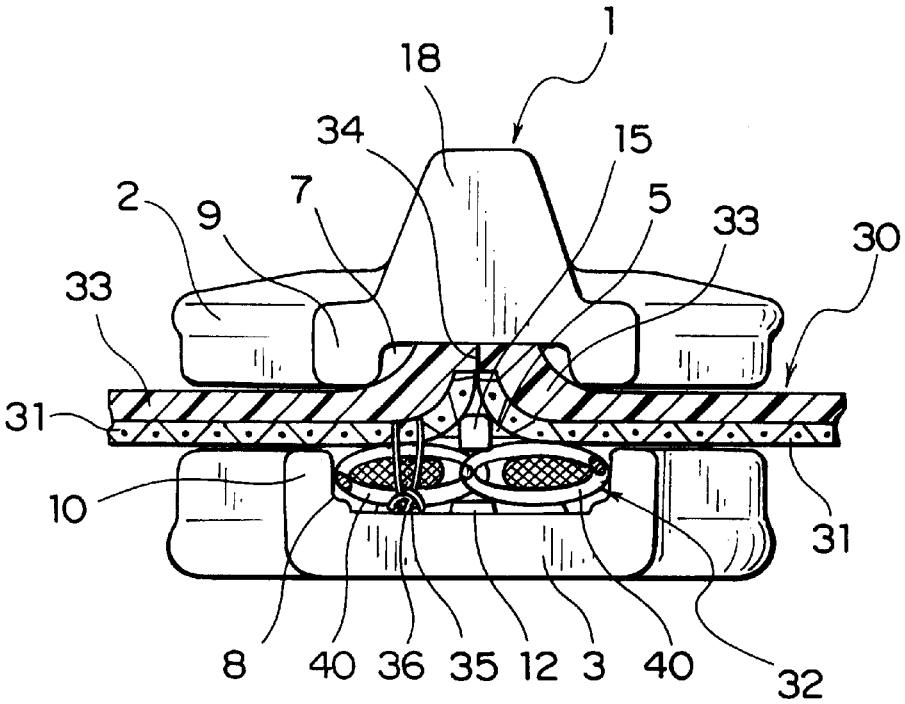
FIG. 5 is a sectional view in which an airtight and watertight slide fastener provided with the above slider is cut at a rear port side of the slider.
Figure 10:
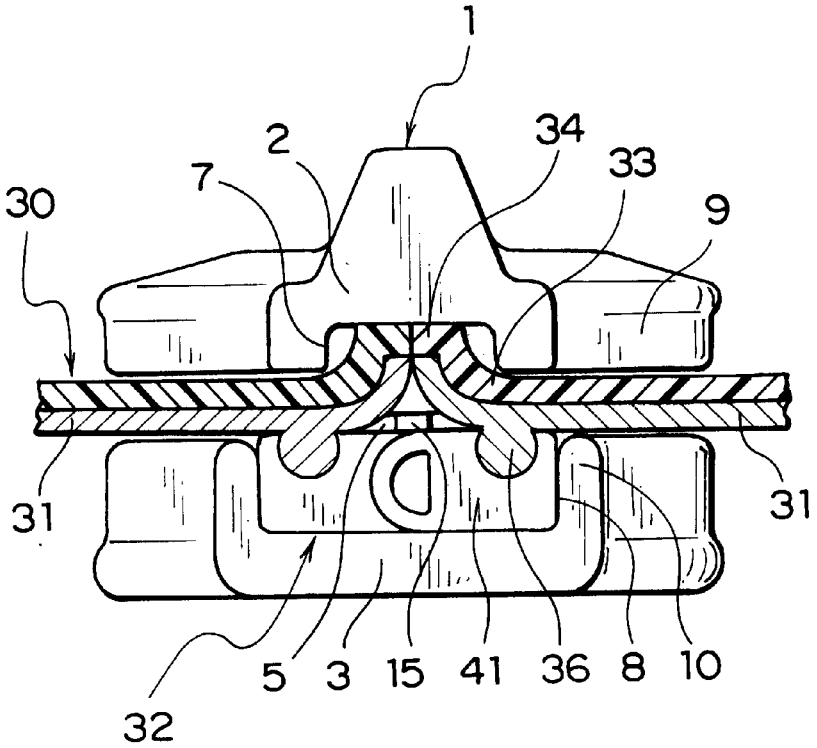
FIG. 10 is a sectional view in which an airtight and watertight slide fastener provided with the above slider is cut at a rear port side of the slider.

As shown in FIGS. 5 and 10, in a fastener chain 30 in which the slider for the airtight and watertight slide fastener according to the present invention is used, fastener elements 32 are attached on a surface of one longitudinal edge of a fastener tape 31 made of synthetic fiber. The fastener elements 32 are formed of linear fastener element 40 in a coil or a zigzag shape formed by a monofilament made of a synthetic fiber, discrete fastener elements 41 formed by pressing an alloy of zinc, an alloy of aluminum or the like and further, discrete fastener elements 41 molded by injection-molding by use of a thermoplastic resin.

As an elastic member, a natural rubber, a synthetic rubber, elastmer of polyethylene terephthalate system, polyamide system and polyurethane system or the like is attached on a surface and one longitudinal edge of the fastener tape 31 in this fastener chain 30 by fusing or adhesive bonding so as to form a seal member 33 provided with water proof. The seal member 33 is formed in such a manner that a length from a fixed point 36, on which the linear fastener element 40 or the discrete fastener element 41 is attached to the fastener tape 31, to the end thereof is longer than a length of the fastener element 32 from the fixed point 36 attached to the fastener tape 31 to the end of the fastener element 32. Then, when the right and left fastener elements 32 are coupled with each other, the front ends thereof abut against each other to form an overlapped close area 34 of the seal member 33 and provide airtightness and watertightness to the fastener chain 30.

Figure 1:
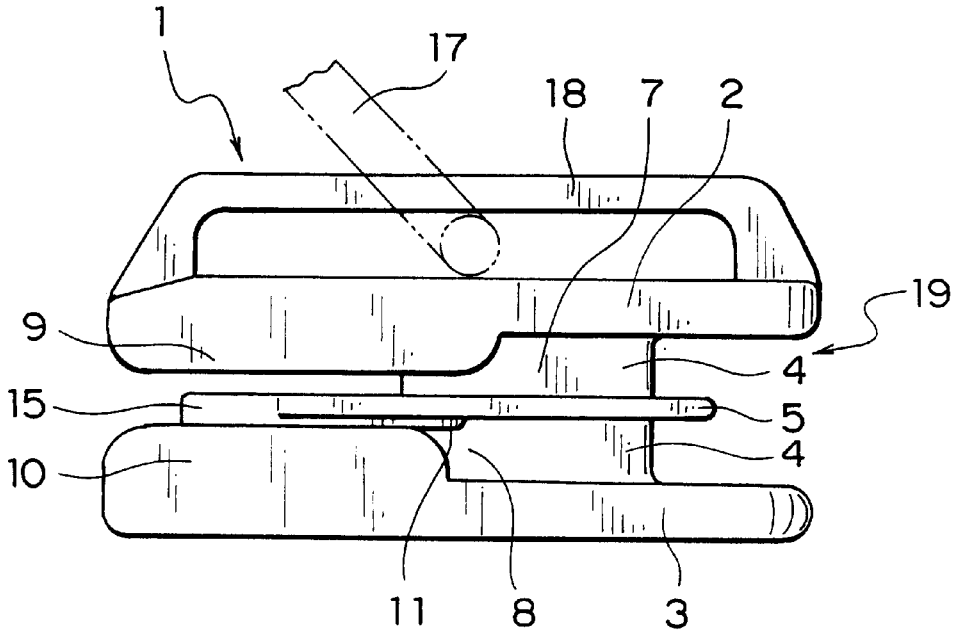
FIG. 1 is a side view of a slider for an airtight and watertight slide fastener according to a first embodiment of the present invention.
Figure 2:
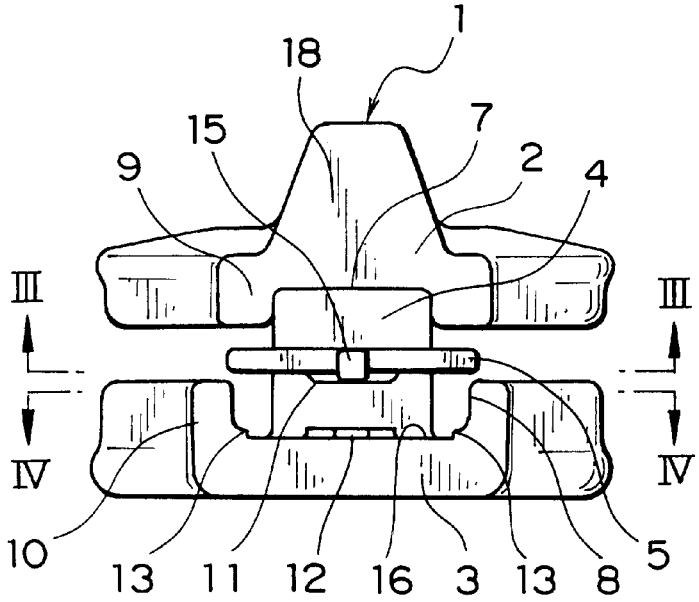
FIG. 2 is a front view of the slider shown in FIG. 1.

As shown in FIGS. 1 and 2, in a slider to be used for opening and closing the above described airtight and watertight fastener chain 30, a body 1 of the slider has an upper wing 2 and a lower wing 3 connected at a center toward a shoulder port 19 by a guide post 4, a partition plate 5 is fixed in the middle of the guide post 4 in parallel with the upper wing 2 and the lower wing 3, an insertion path 7 in which the seal member 33 is inserted is formed on an upper side of the partition plate 5, and an insertion path 8 in which the fastener elements 32 are inserted is formed on a lower side of the partition plate 5. From the middle of the opposite sides of the upper wing 2 to a rear port 14, the flanges 9 are provided to guide seal members 33 at their protruding overlapped close area 34 which are overlapped and closed. Further, from the middle of the opposite sides of the lower wing 3 to the rear port 14, flanges 10 for guiding the fastener elements 32 in a coupled state are protruded. The partition plate 5 is positioned substantially in the middle of the guide post 4. However, this position should be appropriately determined in accordance with a thickness of the fastener element 32 and of the seal member 33. Preferably, as shown in FIGS. 1 and 2, the partition plate 5 is fixed to the guide post 4 to be positioned between tip end surfaces of the flanges 9 and 10 in order to facilitate the fastener tapes 31 and the seal members 33 to be inserted into the insertion path 7 from spacings between the tip end surfaces of the flanges 9 and 10. Spacing between the flanges 9 on the upper wing 2 is formed to be narrower than that between the flanges 10 of the lower wing 3.

The configurations of the flanges 9 and 10 are decided depending on the configuration and the size of the linear fastener element 40 or the discrete fastener element 41 and the thickness of the elastic member 35 attached on the fastener tape 31, so that the spacing between the flanges 9 on the upper wing 2 may be larger than the spacing between the flanges 10 on the lower wing 3 and further the spacing between the flanges 9 on the upper wing 2 may be the same as the spacing between the flanges 10 on the lower wing 3.

Figure 3:
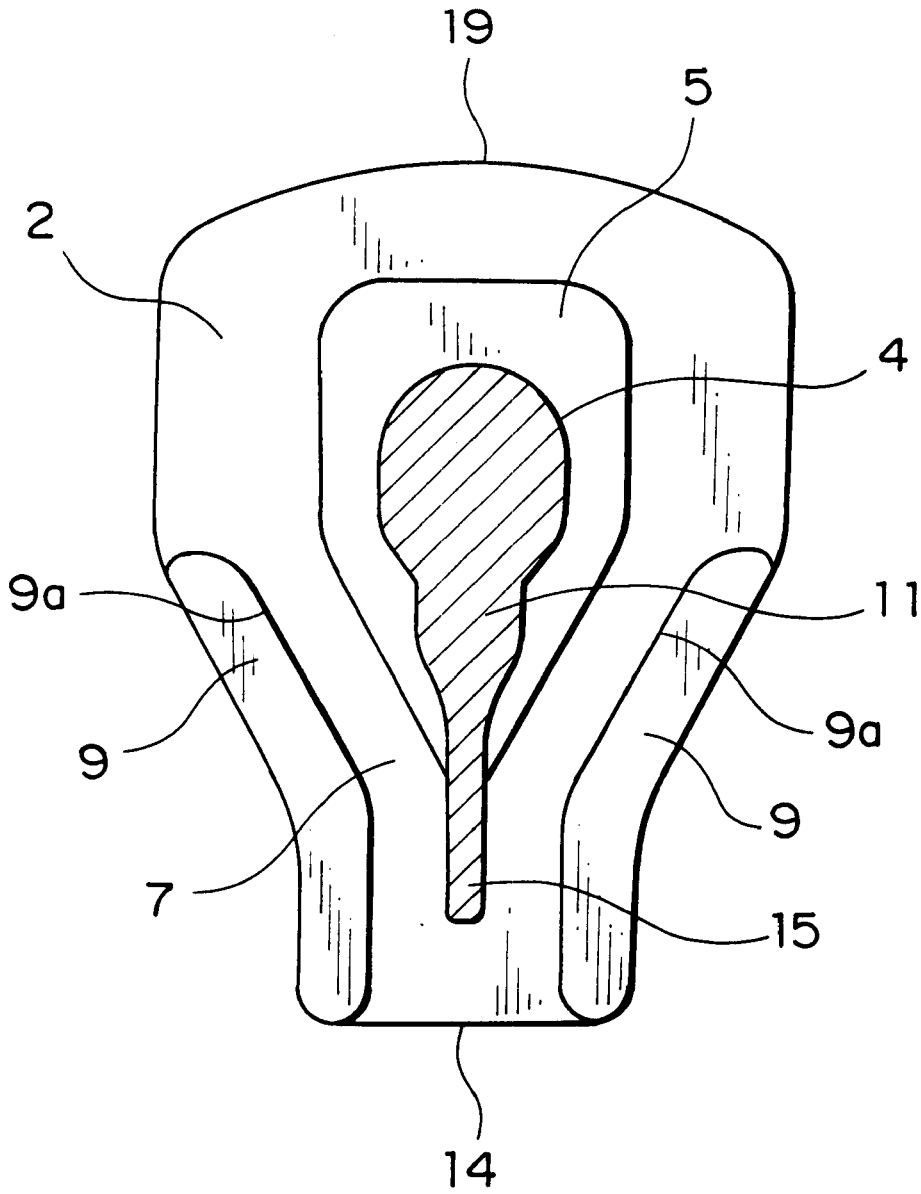
FIG. 3 is a sectional view of the slider taken along the line III–III shown in FIG. 2.

The partition plate 5 fixed on the guide post 4 is arranged between the flanges 9 on the upper wing plate 2 and the flanges 10 on the lower wing 3. Further, as shown in FIG. 3, the partition plate 5 is formed to have a substantially elongated pentagonal plate-type body having two sides parallel to oblique portions 9*a* in the flanges 9 protruded on the upper wing 2. The spacing between the partition plate 5 and the flange 9 is wide enough for the seal member 33 of the fastener chain 30 to be inserted therein.

Figure 4:
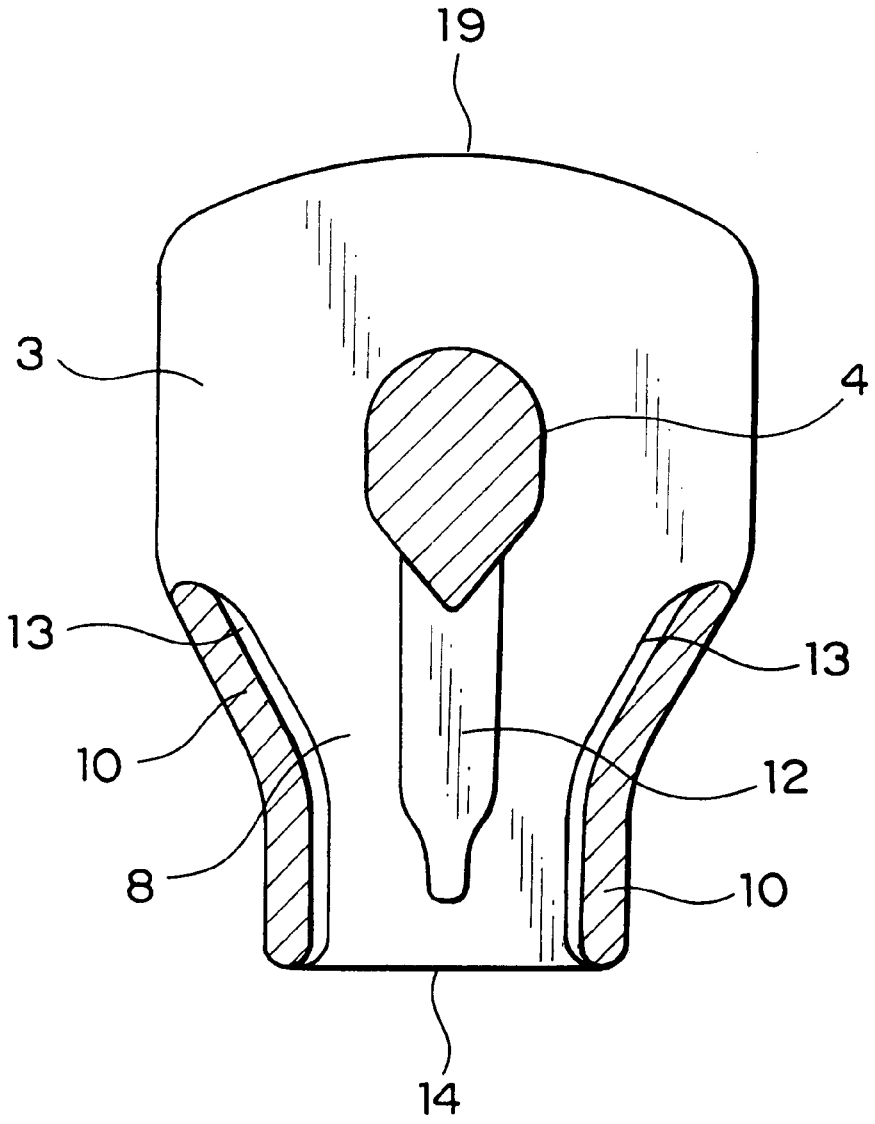
FIG. 4 is a sectional view of the slider taken along the line IV–IV shown in FIG. 2.

As shown in FIG. 3, a pressing portion 11 for pressing an upper surface of the linear fastener element 40 at a coupling head side is disposed on a lower surface of the partition plate 5 in the direction from the guide post 4 to the side of the rear port 14. As shown in FIG. 4, a pressing portion 12 for pressing a lower surface of the linear fastener element 40 at the coupling head side is disposed on an inner surface of the lower wing 3, opposing to the pressing portion 11 in the direction from the guide post 4 to the side of the rear port 14, so that the coupling head side of the linear fastener element 40, which is slid in the insertion path 8, is guided to an accurate posture. A guide portion 13 protruding in a convex shape is disposed on a base portion of the flanges 10 on the opposite sides of the lower wing 3 so as to guide a reverse portion of the linear fastener element 40 is guided to the accurate posture and a guide groove 16 for preventing a sewing thread 35 which attaches the linear fastener element 40, with respect to the pressing portion 12, is disposed. Further, a protruding bar 15 is provided to extend at a distal end of the side of the rear port 14 of the partition plate 5, a lower surface of the protruding bar 15 is made into a flat surface connected to a surface of the pressing portion 11, and the linear fastener element 40 in the fastener chain 30 and the seal member 33 are appropriately separated to be guided. Further, on a surface of the upper wing 2, a pull attaching portion 18 is provided in such a manner that a pull 17 is capable of being slid across an entire length of the upper wing 2.

A usage manner of a slider will be explained below. The linear fastener element 40 attached to one longitudinal edge of the fastener tape 31 of the fastener chain 30 is inserted in the insertion path 8, which is provided between the lower wing 3 and the partition plate 5 of the slider body 1. Further, the seal member 33 formed with the fastener tape 31 and the elastic member attached on the surface of the fastener tape 31 is inserted in the insertion path 7, which is provided between the upper wing 2 and the partition plate 5. After the protruding bar 15 of the partition plate 5 is interposed with respect to the overlapped close area 34, which is protruded when the linear fastener elements 40 and the right and left seal members 33 abutted, the slider is slid in the direction of opening and closing so as to open or close the fastener chain 30. Then, even if the linear fastener element 40 is inclined by an outer force such as a twisting force or the like applied to the fastener chain 30 and is inserted in the insertion path 8 at an unstable posture such that the opposing coupling heads are not accurately opposed, the pressing portions 11 and 12, which are provided on the lower surface of the partition plate 5 and the inner surface of the lower wing plate 3, press the upper and lower surfaces at the side of the coupling heads, so that the opposing coupling heads are corrected into the right posture and the coupling is made at the right posture in a coupling operation area.

The upper surfaces of the coupling heads are pressed by the protruding bar 15 across from just behind the right and left linear fastener elements 40 are coupled with each other to the rear port 14 of the slider, so that the force pulling the seal member 33 to the overlapped close area 34 is prevented from exerting an influence on the posture of the linear fastener elements 40 which is sliding in the insertion path 8. Further, the force pulling the seal member 33 to the overlapped close area 34 guides the linear fastener elements 40 to the rear port 14 as holding the posture thereof in a good state, so that the moving operation of the slider is smoothly performed.

Figure 6:
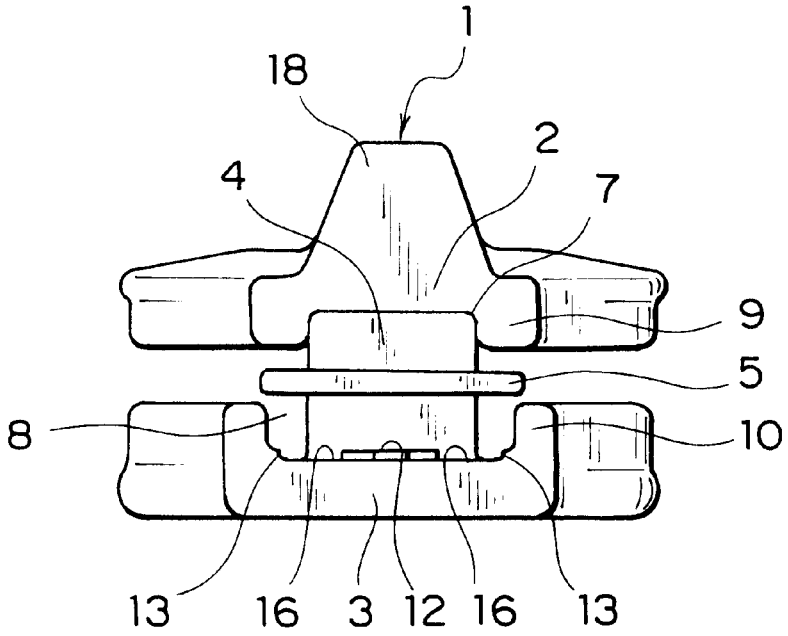
FIG. 6 is a front view for illustrating a modified example of the slider.

As a modified example of the body 1 of the slider, as shown in FIG. 6, only the pressing portion 12 for pressing the linear fastener elements 40 is disposed on the center of the opposing surface of the lower wing 3. Without providing the pressing portion 11 for pressing the linear fastener elements 40 in the longitudinal direction on the lower surface of the partition plate 5 and the protruding bar 15 at the front end thereof, so that the lower surface is flat.

According to this modified example, a state such that the coupling head of the linear fastener elements 40 of the fastener chain 30 stands in a direction opposite to the side of the overlapped close area 34, namely, a state such that the side of the coupling head is inclined to the lower direction is corrected to a normal posture, so that it is possible that the linear fastener elements 40 are coupled at a correct posture with which the opposing coupling heads are opposed each other.

Figure 7:
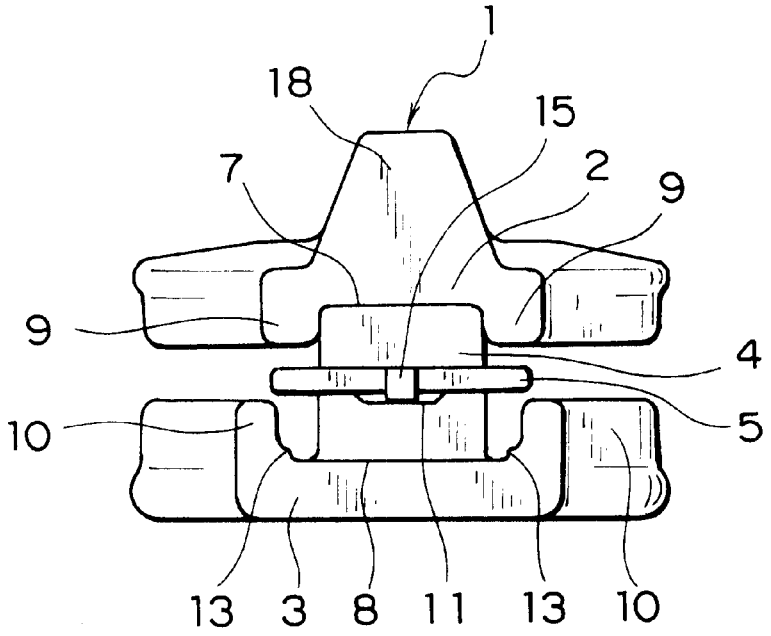
FIG. 7 is a front view for illustrating another modified example of the slider.

According to a modified example of the body 1 shown in FIG. 7, the pressing portion 12 for pressing the linear fastener element 40 in the central longitudinal direction of the lower wing 3 is not provided, so that the inner surface of the lower wing 3 is flat. However, the convex guide portions 13 are disposed at the base portions of the flanges 10 at the opposite sides of the lower wing 3. Then, the pressing portion 11 for pressing the linear fastener element 40 is provided in the central longitudinal direction in the lower surface of the partition plate 5. And the protruding bar 15 is provided to extend at a distal end of the side of the rear port 14 of the pressing portion 11.

According to this modified example, a state such that the coupling head of the linear fastener elements 40 of the fastener chain 30 is pulled to the side of the overlapped close area 34, namely, a state such that the side of the coupling head is lifted to the upper direction to be inclined is corrected to a normal posture, so that the linear fastener elements 40 can be coupled with each other at a correct posture that the opposing coupling heads are opposed each other.

Figure 8:
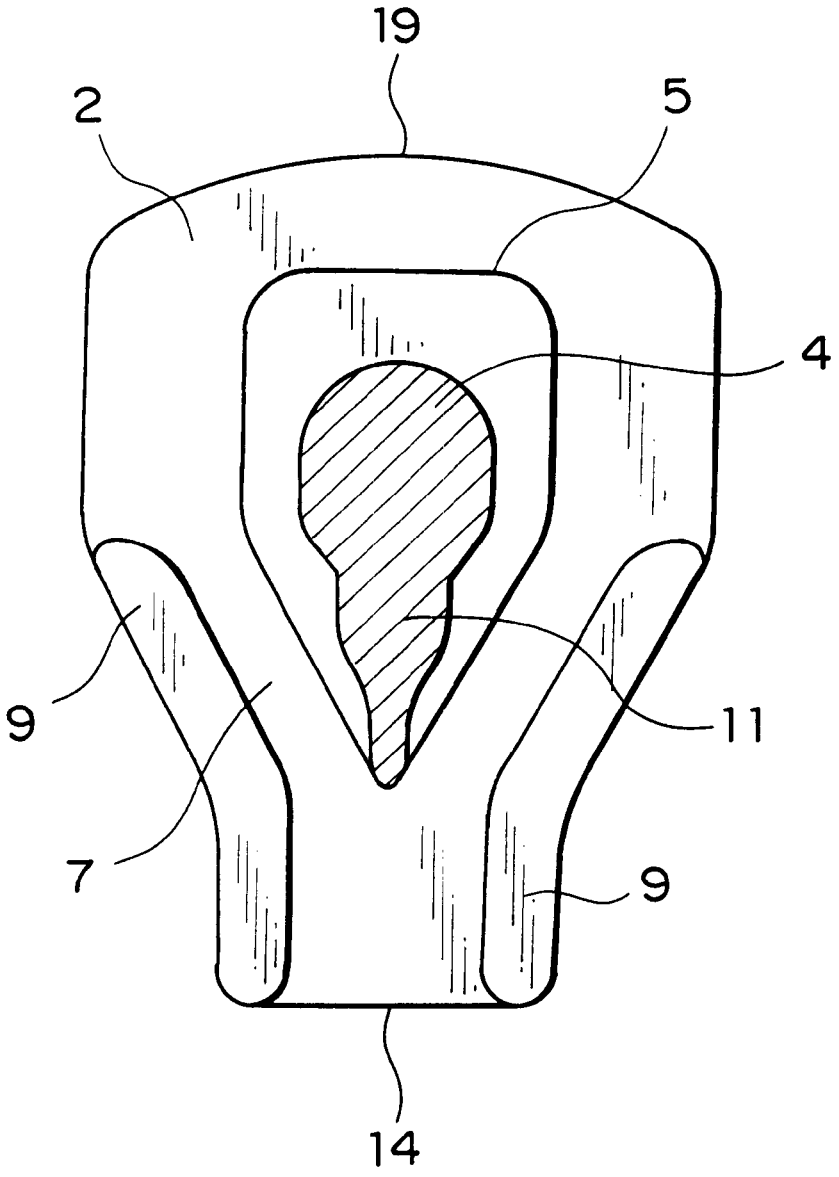
FIG. 8 is a cross sectional view for illustrating still another modified example of the slider.

According to the modified example of the body 1 of the slider shown in FIG. 8, the pressing portion 11 is provided on the lower surface of the partition plate 5 without the protruding bar 15 at the distal end of the partition plate 5. The pressing portion 11 should exist at least in a portion reaching to the coupling operation area of the linear fastener element 40 and allows the posture of the linear fastener elements 40 until they are coupled with each other to be corrected to a correct posture. Also, the pressing portion 12 provided on the lower wing 3 should be extended at least to the portion of the coupling operation area, where the linear fastener elements 40 are coupled with each other, in the direction of the rear port 14.

Figure 9:
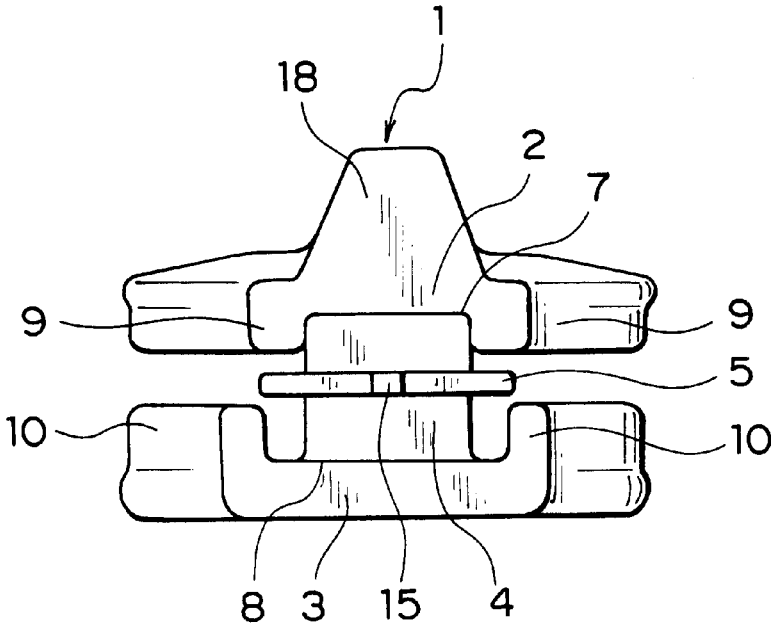
FIG. 9 is a front view of a slider for an airtight and watertight slide fastener according to a second embodiment of the present invention.

Next, a slider according to a second embodiment of the present invention shown in FIG. 9 will be explained below. This slider is a type for using the discrete fastener element 41 made of a metal or the discrete fastener element 41 made of a thermoplastic resin as a fastener element 32. The body 1 of the slider has the upper wing 2 and the lower wing 3 connected by the guide post 4, and the partition plate 5 is fixed in the middle of the guide post 4. The insertion path 7 of the seal member 33 of the fastener chain 30 is provided on the upper side of the partition plate 5 and the insertion path 8 of the discrete fastener element 41 is provided on the lower side of the partition plate 5. Further, at a distal end of the side of the rear port 14 of the partition plate 5, the protruding bar 15 is provided to extend and the pressing portion is not provided on the lower surface of protruding bar 15, so that the lower surface of the protruding bar 15 is made into a flat surface. Also, the inner surface of the lower wing 3 is formed in a flat surface and the convex guide portions 13 are not provided on the base portions of the flanges 10 on the opposite sides of the lower wing 3. This configuration is formed to be suited to the discrete fastener element 41. Other features are the same as those of the slider according to the first embodiment.

It is possible to manufacture the above described slider of respective types by a metal die casting integral molding by using an alloy of zinc or an alloy of aluminum or the like in a state that the upper wing 2, the lower wing 3, the guide post 4 and the partition plate 5 of the body 1 are arranged in a predetermined positions, so that the above described slider of respective types can be manufactured all at once. Alternatively, as the means for manufacturing the slider other than the die casting molding, there is means for dividing the slider into some parts to be assembled to the slider.

Figure 11:
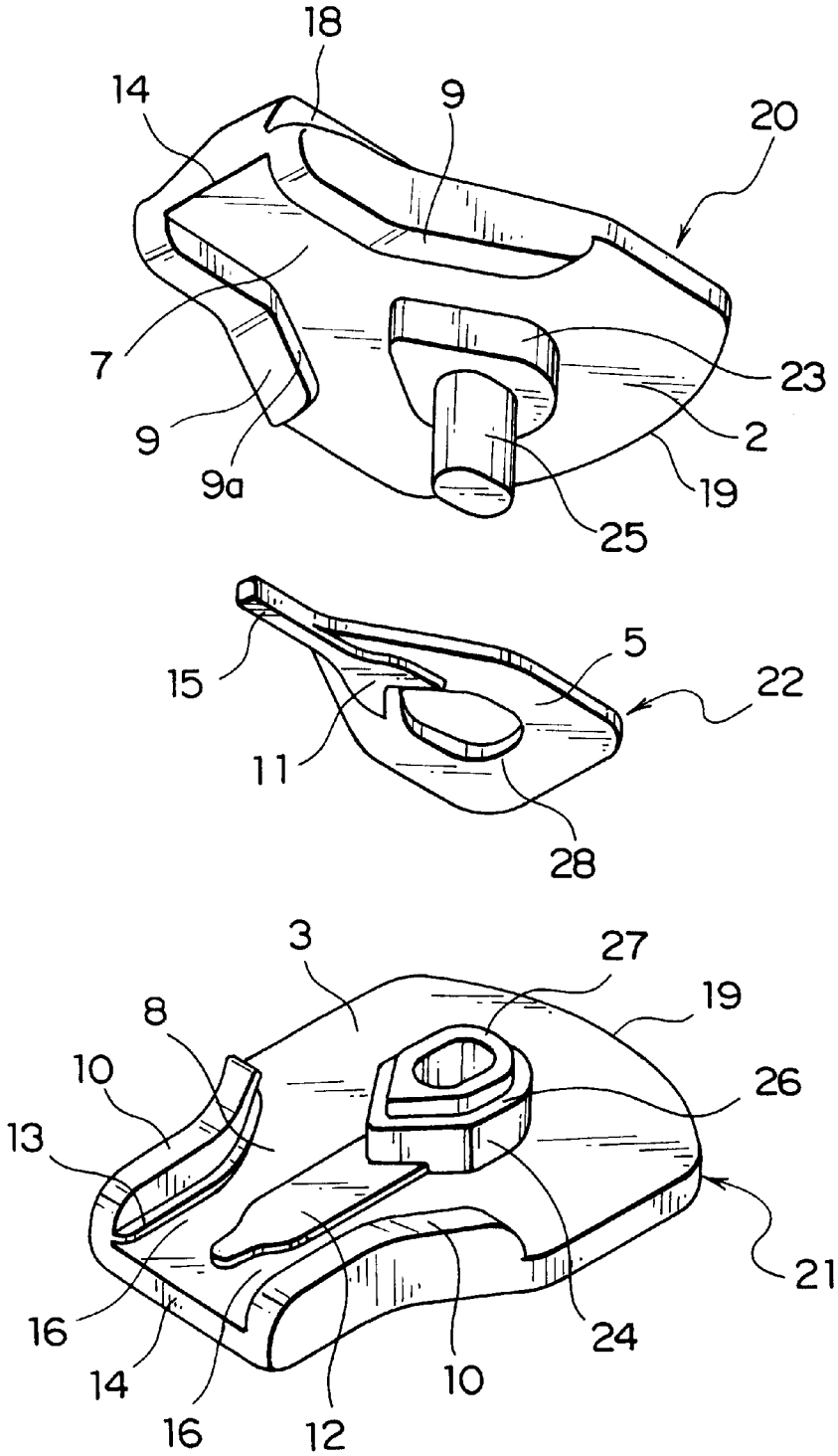
FIG. 11 is an exploded perspective view of an airtight and watertight slider formed by some parts according to a third embodiment of the present invention.
Figure 12:
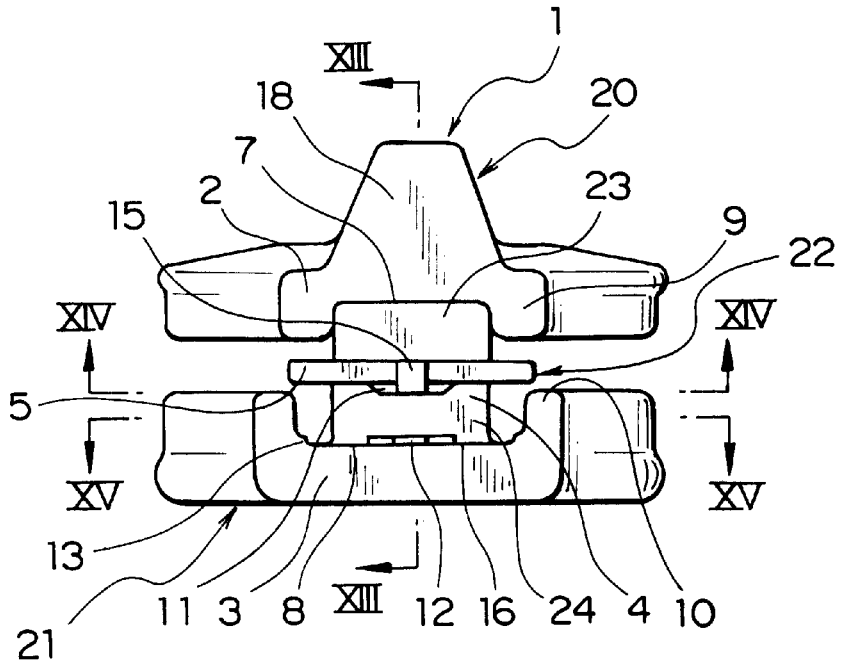
FIG. 12 is a front view of the slider shown in FIG. 11.
Figure 13:
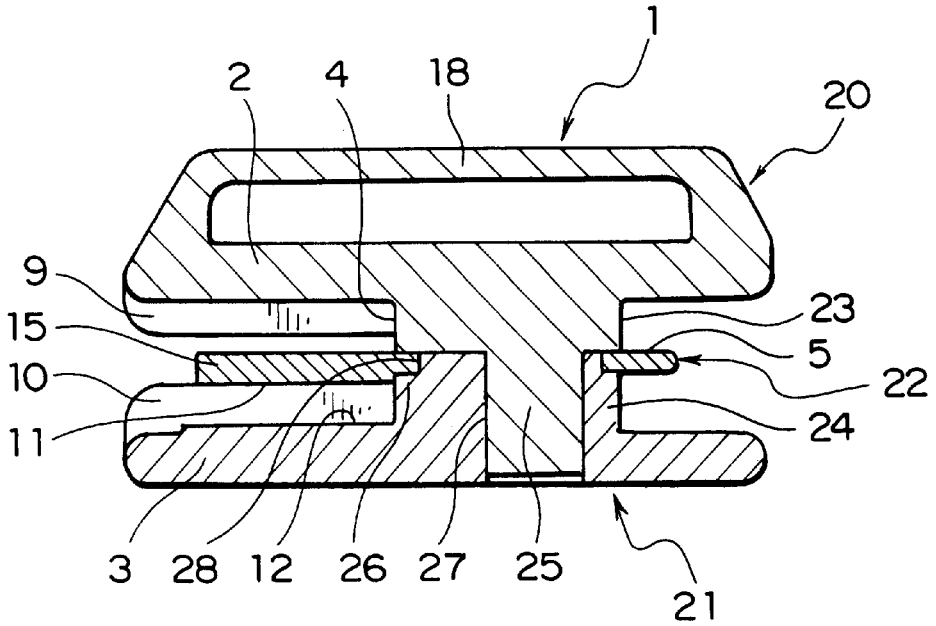
FIG. 13 is a sectional view of the slider taken along the line XIII–XIII shown in FIG. 12.
Figure 14:
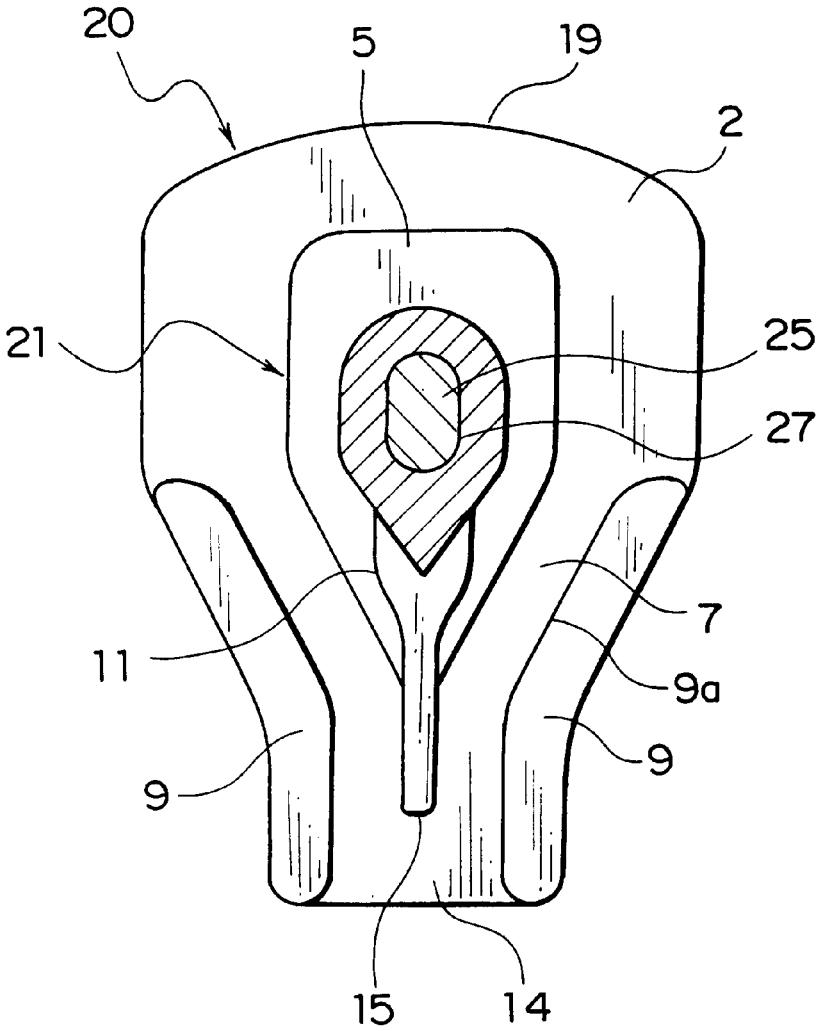
FIG. 14 is a sectional view of the slider taken along the line XIV–XIV shown in FIG. 12.
Figure 15:
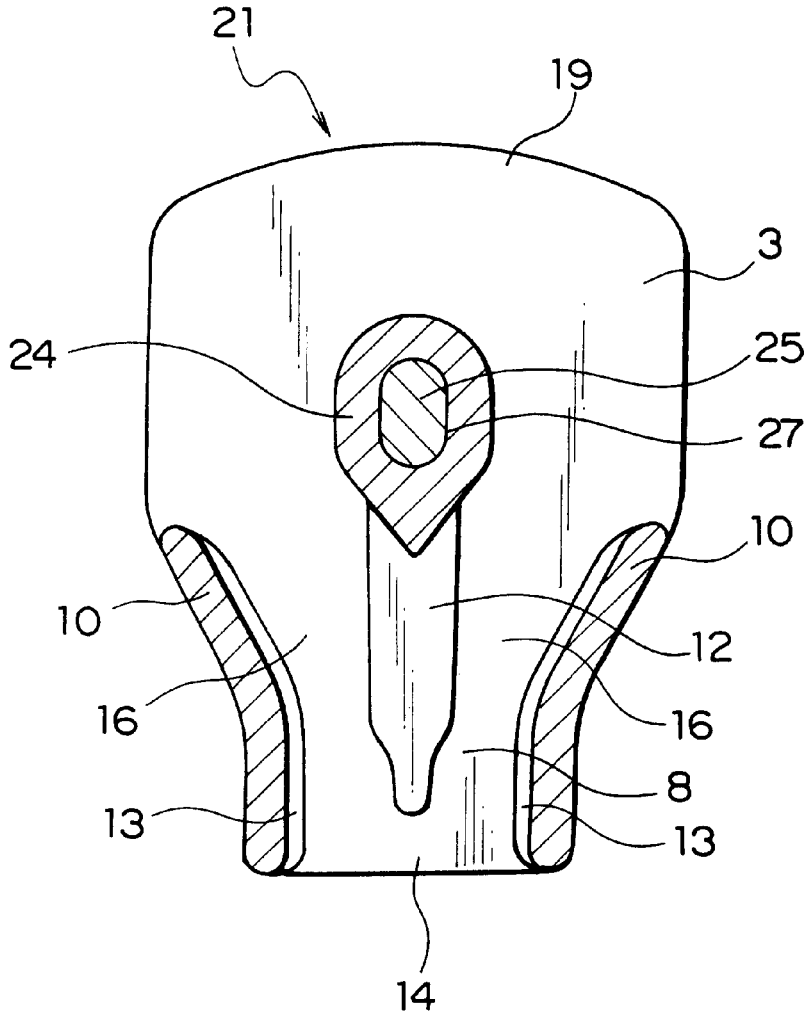
FIG. 15 is a sectional view of the slider taken along the line XV–XV shown in FIG. 12.
Figure 16:
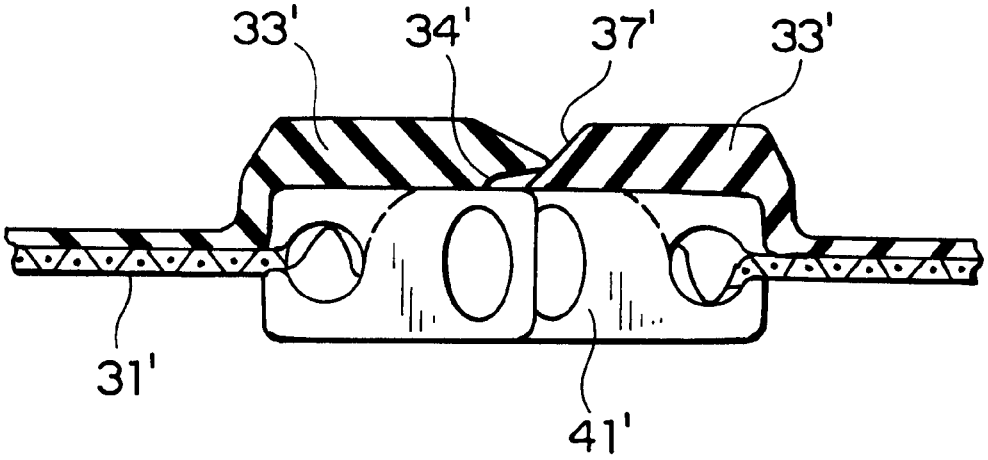
FIG. 16 PRIOR ART
FIG. 16 is a sectional cross view of a well known airtight and watertight slide fastener.

With respect to the above described type of assembling the body 1 of the slider, a third embodiment according to the invention is shown in FIGS. 11 to 15. As shown in FIG. 11, the body 1 of the slider is divided into three parts, namely, an upper wing member 20, a lower wing member 21 and a partition plate member 22. The pull attaching portion 18 is provided across an entire length of a surface of the upper wing plate member 20. An upper guide post 23 is protruded at a center portion of the lower surface of the upper wing member 20 toward the side of the shoulder port 19 and an insertion bar 25 is protruded at a center of the surface of this upper guide post 23. Further, on the opposite sides of the upper wing plate member 20, the flanges 9 having narrow spacing and guiding a closing portion of the seal member 33 is protruded.

In the lower wing member 21, a lower side guide post 24 corresponding to the upper guide post 23 provided on the upper wing member 20 is protruded at a center portion thereof toward the side of the shoulder port 19. Further, the convex pressing portion 12 for pressing the coupling head side of the linear fastener element 40 is provided from the base portion of this lower guide post 24 to the rear port 14. The flanges 10 having larger spacing compared to the spacing of the flanges 9 on the upper wing member 20 and guiding the coupling of the linear fastener element 40 are protruded on the opposite sides of the lower wing member 21. On an upper surface of the lower guide post 24, a shelf portion 26 cut by a predetermined width and the thickness of the partition plate member 22 is provided and a through hole 28 defined in the partition plate member 22 is fit with the shelf portion 26, so that the partition plate member 22 is held with the shelf portion 26. Then, at a center of the lower guide post 24, an insertion hole 27, in which the insertion bar 25 protruded on the upper guide post 23 can be inserted, is defined.

The partition plate member 22 is formed by a substantially pentagonal plate-type body having two sides parallel to the oblique portions 9*a* in the flanges 9 protruded on the upper wing member 20. The through hole 28 which can be fitted with the shelf portion 26 provided on the lower guide post 24 is protruded at a center of this partition plate member 22. The pressing portion 11 for pressing the coupling head side of the linear fastener element 40 is provided from the vicinity of the through hole 28 to the distal end of the partition plate member 22, and the protruding bar 15 in a bar shape is integrally provided at the distal end of the pressing portion 11.

In order to form a slider by assembling the above described respective parts, namely, the upper wing member 20, the lower wing member 21, and the partition plate member 22, at first, the through hole 28 provided on the partition plate member 22 is fitted with the shelf portion 26 of the lower guide post 24 of the lower wing member 21 with the pressing portions 11 and 12 for the linear fastener element 40 being opposed with each other, and the upper wing member 20 is put on the partition plate member 22. The insertion bar 25 protruded on the upper guide post 23 of the upper wing member 20 is inserted in the insertion hole 27 provided on the lower guide post 24, so as to fuse the insertion bar 25 and the insertion hole 27 together while the partition plate member 22 is clipped between the upper guide post 23 and the lower side guide post 24, or a tip end of the insertion bar 25 is pressingly squashed to be fixed on the lower wing member 21 so as to compose the slider.

Additionally, the insertion bar 25 may be provided on the lower guide post 24 and the insertion hole 27 may be provided on the upper guide post 23. And the shelf portion 26 may be provided on the upper guide post 23. Further, it is possible to freely change the arrangement of the pressing portions 11 and 12 of the partition plate member 22.

What is claimed is:

1. A slider for an airtight and watertight slide fastener comprising a body having an upper wing and a lower wing with flanges on both of right and left sides, respectively, the wings being connected by a guide post, wherein a partition plate is arranged in parallel in said guide post to form an insertion path for a seal member on an upper side thereof and to form an insertion path for a fastener element on a lower side thereof, and wherein pressing portions for pressing the fastener element are provided on at least one of opposing surfaces of the partition plate and the lower wing at a portion from said guide post reaching to at least a coupling operation area of the fastener element.

2. A slider for an airtight and watertight slide fastener comprising a body having an upper wing and a lower wing with flanges on both of right and left sides, respectively, the wings being connected by a guide post, wherein a partition plate is arranged in parallel in said guide post to form an insertion path for a seal member on an upper side thereof and to form an insertion path for a fastener element on a lower side thereof, and wherein a protruding bar is integrally provided so as to extend from a distal end of the partition plate toward a portion beyond at least a coupling operation area of the fastener element, and wherein surfaces of the partition plate and the protruding bar and a surface of the lower wing, which are opposed to each other, are flat surfaces.

3. The slider for an airtight and watertight slide fastener according to claim 1, wherein a protruding bar is integrally provided so as to extend from a distal end of the partition plate toward a rear port.

4. The slider for an airtight and watertight slide fastener according to claim 1, wherein said pressing portions are provided on both said partition plate and said lower wing.

5. The slider for an airtight and watertight slide fastener according to claim 1 or 2, wherein said slider is composed of an upper wing member, a lower wing member and a partition plate member in such a manner that an upper guide post protruded toward said lower wing member is provided on said upper wing member; a lower guide post protruded toward said upper wing member is provided on said lower wing member; and a partition plate member is arranged between said upper guide post and said lower guide post to be clipped therebetween so as to compose said slider.

6. The slider for an airtight and watertight slide fastener according to claim 5, wherein an insertion bar is provided on one of said upper guide post and said lower guide post; an insertion hole, in which said insertion bar is capable of being inserted, is provided on the other of said upper guide post and said lower guide post; and a through hole, in which said insertion bar is capable of being inserted, is provided on said partition plate member.

7. The slider for an airtight and watertight slide fastener according to claim 6, wherein a shelf portion on which said partition plate member can be placed is provided on any one of said upper guide post and said lower guide post.

8. The slider for an airtight and watertight slide fastener according to claim 1 or 2, wherein said slider in which said upper wing, said lower wing, said guide post, and said partition plate are arranged at predetermined positions, is composed integrally of a single material.

9. The slider for an airtight and watertight slide fastener according to claim 1 or 2, wherein a spacing between said flanges disposed at opposite sides of the insertion path of the seal member at the upper wing is formed to be narrower than a spacing between said flanges disposed at opposite sides of the insertion path of the fastener element at the lower wing.

10. The slider for an airtight and watertight slide fastener according to claim 1, wherein the pressing portions are formed on the lower wing, and convex guide portions are formed between the lower wing and the respective flanges provided on both of opposing sides of the lower wing.

* * * * *